US005538226A

United States Patent [19]

della Foglia

[11] Patent Number: 5,538,226

[45] Date of Patent: Jul. 23, 1996

[54] PUSHING MACHINE MOVEABLE ON RAIL FOR OPERATING INTO THE SLAG HOLE OF STEEL SMELTING ELECTRIC FURNACES

[75] Inventor: Ugo della Foglia, Milan, Italy

[73] Assignee: Dalmine S.p.A., Bergamo, Italy

[21] Appl. No.: 403,800

[22] PCT Filed: Jun. 22, 1994

[86] PCT No.: PCT/IT94/00092

§ 371 Date: Mar. 17, 1995

§ 102(e) Date: Mar. 17, 1995

[87] PCT Pub. No.: WO95/04250

PCT Pub. Date: Feb. 9, 1995

[30] Foreign Application Priority Data

Jul. 30, 1993 [IT] Italy ..... MI93A1739

[51] Int. Cl.[6] ..... C21B 3/04

[52] U.S. Cl. ..... 266/228; 266/271

[58] Field of Search ..... 266/271, 228, 266/227

[56] References Cited

U.S. PATENT DOCUMENTS 3,258,256 6/1966 Brooke ..... 266/228

FOREIGN PATENT DOCUMENTS 2344799 10/1977 France .
1077875 3/1960 Germany .
WO86/02437 8/1986 WIPO .

*Primary Examiner*—Scott Kastler
*Attorney, Agent, or Firm*—Panitch Schwarze Jacobs & Nadel

[57] ABSTRACT

A pushing machine is described, which is capable of running to opposite directions, upon remote control, along a length of rail provided in front of the mouth or slag hole of an electric furnace (10) for the smelting of iron products. It shows, at the end of an arm (5, 5*a*) telescopically extensible and preferably pivoting to be able to swing also in the vertical plane, a head or front shield (6) mounted on a frame (1) which can be anchored to the ground and is slidable on rails by means of wheels (2, 2' . . . ), at least two of which are driving wheels. Said shield (6), having a size slightly smaller than the slag hole, has the function of keeping the scrap at the inside of the furnace during the charging operation and keeping the threshold free of the slag without any operator's intervention.

14 Claims, 3 Drawing Sheets

6
5a
9'
9
23'
23
12
11'
11
2'a
2a
5
1
7
1
13
2'
8'
8
3'
4
3
2

PUSHING MACHINE MOVEABLE ON RAIL FOR OPERATING INTO THE SLAG HOLE OF STEEL SMELTING ELECTRIC FURNACES

FIELD OF THE INVENTION

The present invention relates to a pushing machine movable on rail, adapted to operate into the slag hole of electric furnaces for smelting of steel or iron products in general, to be remotely controlled.

BACKGROUND OF THE INVENTION

It is known that the electric furnaces for smelting of iron based scraps being directly discharged from the top have a front opening, also called "slag hole" whose threshold or lower step forms the so-called "dam" suitable to keep the molten bath within the furnace and to be overflown by the slag only, which then is drained at an underlying level through a trap provided on the floor immediately at the outside of the slag hole. The latter also provides the passage for the oxygen lance through which oxygen gas is blown at very high speed directly into the melting zone for refining the melt.

Also some important inconveniences are known, in connection said slag hole and with the presence of mainly deriving from the top charge of the scrap, which causes the obstruction, at least partial, of the so-called "slag runner" which connects the outer mouth of the hole with the molten bath and must remain unobstructed, in particular to allow the oxygen lance without obstacles.

On the other hand it is also known that usually it is necessary to await that a cast is over to carry out, before the subsequent one begins, the so-called operation of "slag hole cleaning", in other words removing the slag, now cooled, that has deposited on the threshold of said hole, as well as remaking the "dam". Of course this involves longer standstill times between one cast and another, with consequent reduction of the production capacity, since it is impossible to carry out these operations by hand with the electrodes being fed, near high temperatures and with the operators under the danger of being hit by sparks or jets of molten metal. Not only, but the removal of eventually cooled, solid slag, forming an integral block with the underlying step of refractory material (usually dolomite), resulted in a substantial demolition of the step itself or "dam" and its remaking, with an additional extension of the plant standstill time.

It has been thought of over coming these inconveniences by using a power shovel that can hold the batch of charged scrap at the inside of the furnace while keeping the slag runner free, but the required presence of an operator on board renders extremely dangerous and nearly impossible this solution unless the operator of the mechanical shovel undergoes unlikely performances such as the temporary leaving of the vehicle as the material drops. Similarly unfeasible results to be the cleaning of the slag hole with active electrodes, when considering the high electric power involved (up to 65 MW).

Therefore the object of the present invention is that of providing an apparatus capable of carrying out the above-mentioned operations, under a remote control and without the presence of an operator on place.

With the pushing machine according to the present invention, during the scrap charge into the furnace a first series of advantages is obtained, among which the most apparent one is that of preventing the scrap from escaping the slag hole, thus increasing the yield, i.e. the ratio between produced steel and charged scrap. Another important advantage in this stage is that the slag runner, as above defined, is kept free and the scrap drops entirely within the furnace, not on the threshold thereof, where it would be lost, thus reducing even more the yield, and wherefrom it should have to be removed with difficulty once solidifyed, with a partial demolition of the threshold itself which then should have to be restored. Furthermore the completely free slag runner means immediate exploitation of the oxygen in the zone where melting occurs, without danger of damaging the lance and anyhow without possible presence of scrap between lance and melt bath which would interfere with the oxygen blow, thus reducing its speed and shielding the temperature gradient.

Another series of advantages afforded by the pushing machine according to the present invention is due to the fact that it can be used for cleaning the slag hole and remaking of the dam at about half casting, when for example the electrodes have delivered a prefixed quantity of specific power (such as for example 200 KWh/ton) and are still active. Thus the power delivery is not interrupted and the standstill time between two subsequent casts is strongly reduced, while the slag overflow level is ensured, as the height of the head shield, being controlled to have the fixed values, keeps automatically constant such a level, thus slag is removed when it is hot, thereby extremely crumbly, without problems of re-building the dam with additional dolomite, all this occurring without any personal intervention, what would clearly involve some risks.

SUMMARY OF THE INVENTION

Briefly stated, the present invention comprises a pushing machine travelling on a rail for operating in the slag hole of steel smelting electric furnaces. The pushing machine comprises a support frame having a front zone and a rear zone mounted on a plurality of sliding wheels, at least two of which are driving wheels. A motor is mounted on the support frame for driving the at least two driving wheels. An extensible arm is mounted on said support frame and includes a front shield having a cross-section slightly smaller than the opening of said slag hole of the furnace. Anchoring means are provided for anchoring said support frame to a fixed location and means for remote control operation of forward and backward movement of the machine, and for separately remotely controlling extension and retraction of the extensible arm and the operation of the anchoring means are provided.

BRIEF DESCRIPTION OF THE DRAWINGS

These and other objects, advantages and features of the pushing machine according to the present invention will be clearer from the following detailed description of a preferred embodiment thereof, given by way of non-limiting example, with reference to the annexed drawings in which.

DETAILED DESCRIPTION OF PREFERRED EMBODIMENTS

Figure 1:
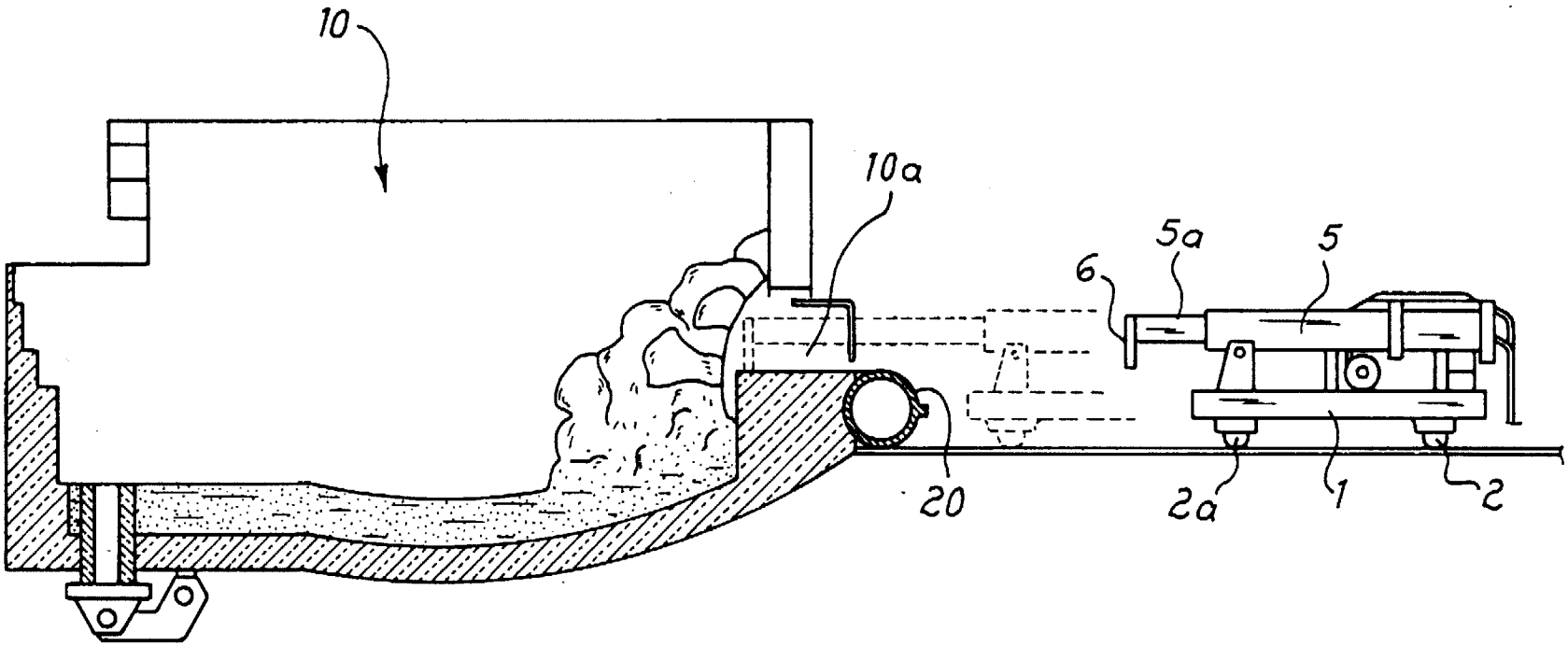
FIG. 1 shows a schematic side view of the pushing machine according to the invention in two different positions with respect to a smelting electric furnace also schematically shown in cross-section.

With reference to the drawings, the pushing machine according to the invention essentially comprises a metal frame 1, mounted on four wheels (which could also be of greater number), at least two of which are driving wheels. In the drawings the rear wheels 2, 2' are assumed to be driving, whereas the front ones 2*a*, 2'*a* are driven. A geared electric motor 3, having for example a power of about 4 HP, directly actuates, through suitable drive mechanisms, a driving axle 3' at the ends of which there are mounted the wheels 2, 2', thus being able to develope a speed of about 20 m/min. The electric feeding of the geared motor 3 is accomplished through an electric cable wound on a reel 13, which is sidely mounted on the frame and is designed to automatically release the cable by unwinding the same at approaching the machine to the furnace 10 and vice versa re-winding it automatically when the machine is caused to move backwards.

On the frame 1 there is centrally mounted an extensible arm formed of two coaxial tubes 5, 5*a*, here shown as having a square cross-section, which however could have any different cross-section shape, at the end of the inner one, designated 5*a*, there is integrally provided a metal head or shaped shield 6 that forms the actual tool of the apparatus. The tube 5*a* of smaller cross-section slides within the outer tube 5 as it is fixed, preferably at its end zone near to the head 6, as better shown in FIG. 3, to a central piston rod of a piston-cylinder 15 having the cylinder fixedly mounted to the outer tube 5 of the extensible arm. It preferably shows stiffening ribs 12 spaced along the length and is supported on the frame 1 through a cradle formed of two vertical brackets or lugs 11, 11' between which a pin 17 is mounted. About pin 17 two holed flanges 21 can rotate, which are fixed to the outer tube 5 and consequently the extensible arm. In a rear side zone of tube 5, its outer surface is also fixed to the piston rod, preferably having a fork shape 19, of another cylinder 16 which is vertically mounted on the frame 1. Both cylinders are operated by a pressurized fluid means such as air or preferably oil, in the latter case there being provided a hydraulic system formed of a tank 7 and a pomp-motor unit 4 also fixedly mounted on the frame 1 of the machine and fed by an electric cable, other than that for feeding the geared motor 3. Both cables are independently wound on the reel 13 and through remote controls (not shown), preferably doubled in a control deck and in an emergency push-button panel hanging on the sliding floor of the machine, the forward and backward movements or the stop of the machine itself are controlled, as well as of forward, backward, upward and downward movements of the extensible arm.

Figure 2:
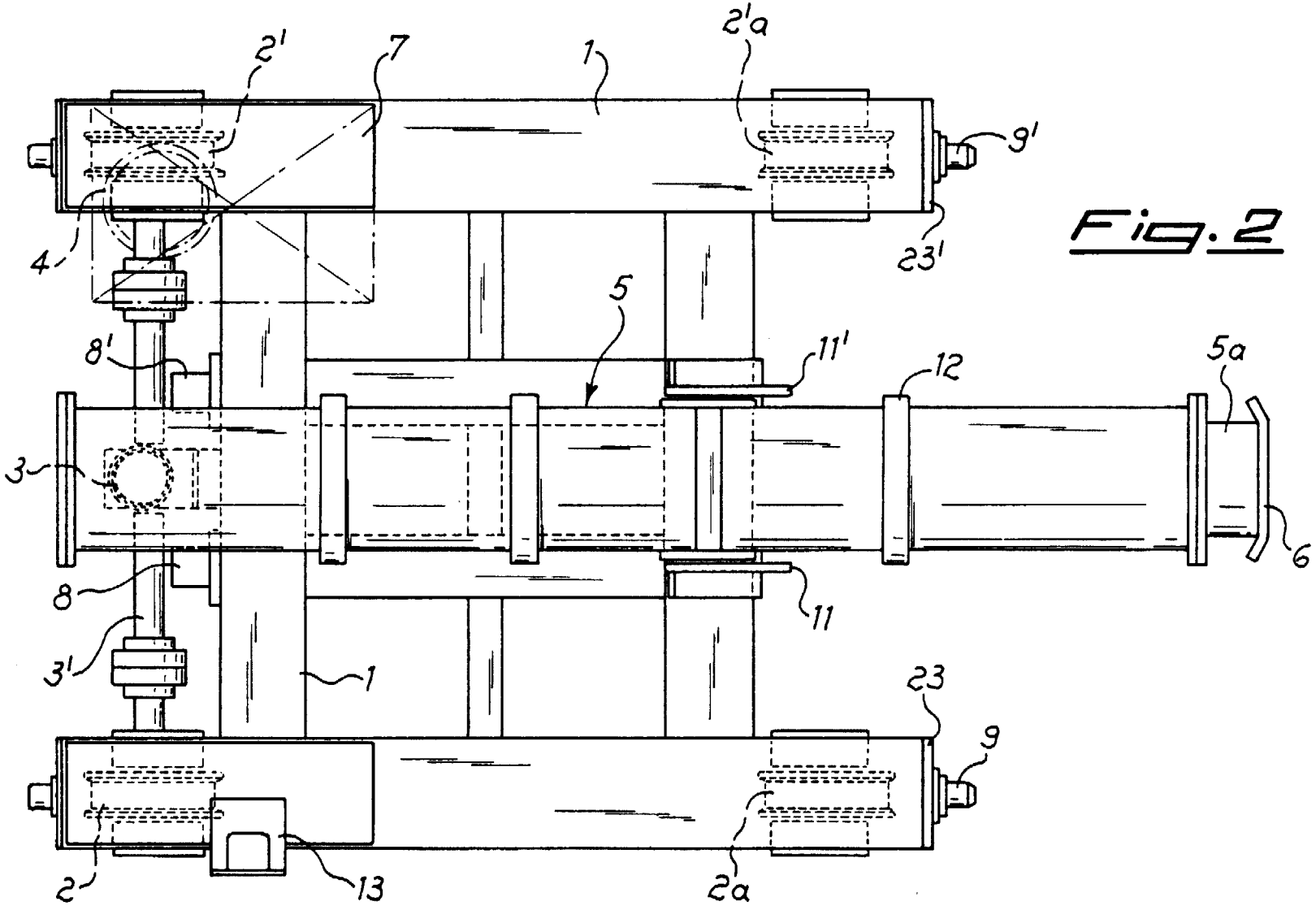
FIG. 2 shows a top plan view of a preferred embodiment of the pushing machine of FIG. 1.
Figure 3:
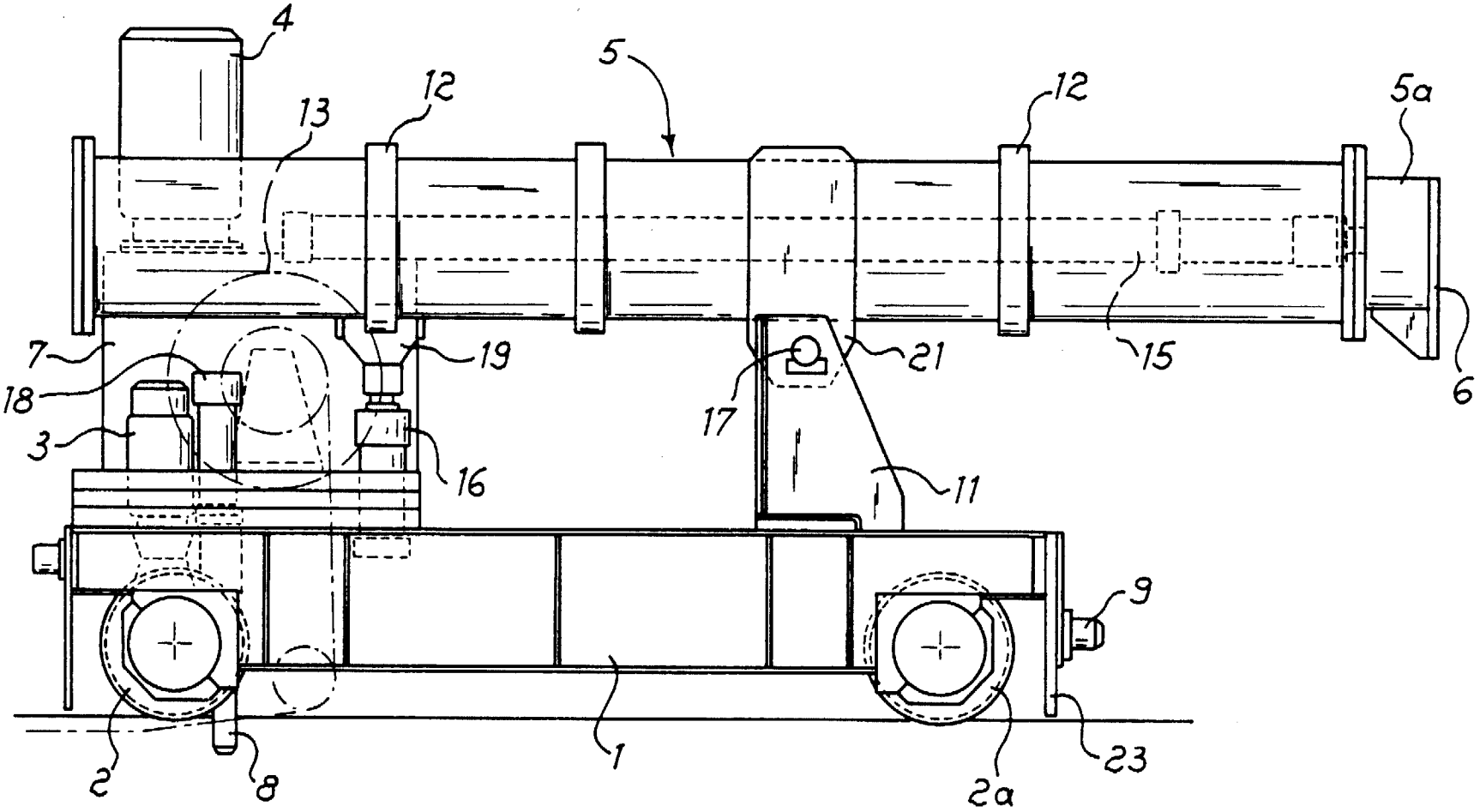
FIG. 3 shows a side view of the pushing machine of FIG. 2.

Still with reference to FIGS. 2 and 3 there are preferably provided, near the rear wheels 2, 2', anchoring means to the ground, mounted in the central zone of the frame 1 at a distance therebetween equal to about the distance between the wheels and formed of two vertical posts 8 longitudinally movable with reciprocating movements as being actuated by a driving cylinder 18. The stroke of posts 8 is such as to reach downwards a position lower than that of contact rail-wheels, thereby the posts can firmly fit into seats formed in the rails themselves or the surrounding floor so that the pushing machine is anchored during its operating manoeuvres, in particular during the forward movement of the extensible arm with shield 6, thus avoiding that by reaction the frame 1 can move backward and the push onto the scrap to be kept within the furnace may fail. The cylinders 18 will be preferably fed through the same hydraulic system comprising the pump 4 and tank 7 upon controls that are also of the remote-type, different from those provided for operating the extensible arm. This anchoring means can of course show any other different embodiment known in the art.

Finally the pushing machine according to the invention will be preferably provided with front horizontal studs 9, 9' mounted on bumper plates 23, 23' fixedly mounted onto the frame and positioned before the front wheels 2*a*, 2'*a* to shield them from impacts. The two front studs 9, 9' are designed to fit into corresponding holes (not shown) formed in metal seats, such as rail sections, embedded in the structure 20 or retaining wall placed before the threshold of the slag hole, against such a wall the pushing machine being blocked at the end of its forward stroke. Thus it is avoided that the machine may undergo a tilting moment during the operation of cleaning and remaking of the dam or in general when the arm 5, 5*a* is swinging in the vertical plane.

From the foregoing it is clear the operation of the pushing machine according to the present invention, which will be moved forward, with shield 6 completely retracted, until reaching its stroke end where the anti-tilting studs 9 are fitted into the seats of structure 20, whereafter the anchoring posts 8, 8' are lowered and the machine is ready for its action through extension of the inner arm 5*a* to carry the head shield 6 near the melting bath, thus ensuring that the slag runner 10*a* is kept clear of scrap during the subsequent charge. Possible manoeuvres of movement can be carried out also in vertical direction, when it is required to push to the inside of furnace 10 pieces of scrap which may assume undesired positions. As the charge is over and melting is at beginning, the machine can move backward to allow the introduction of the oxygen lance through the runner 10*a*, for the direct action of refining onto the molten product. The lance, whose direction is controlled from outside, is not subject to the risks of damages since the runner is free and the oxygen, flowing at a speed that can be even supersonic, is blown in till the inside of the molten bath.

Subsequently, at about half casting, when the electrodes have delivered a prefixed quantity of energy, e.g. 200 KWh/ton, as measured at the control deck the oxygen lance is withdrawn and the pushing machine is caused to move forward again to perform the cleaning and the dam re-building operations, thus ensuring the overflow level of the slag being constant. This operation, carried out with subsequent forward and backward movements of the movable arm, with possible displacement also in the vertical plane to augment the mechanical action on the slag itself, occurs easily upon remote control of an operator who is however able to observe the working area. It will be noticed that when working in these conditions, the slag is at high temperature, thereby is crumbly and easily removable from the underlying layer of dolomite or other refractory material which does not require demolitions and subsequent re-building. Mention has been already made before about the advantages in terms of time, of operating in this stage without prolonging the waiting time between two subsequent casts.

I claim:

1. A pushing machine travelling on a rail for operating in a slag hole of a steel smelting electric furnace comprising:

a support frame having a front zone and a rear zone mounted on a plurality of sliding wheels, at least two of which are driving wheels;

a motor mounted on the support frame for driving said at least two driving wheels;

an extensible arm mounted on said support frame including a front shield having a cross-section slightly smaller than the opening of said slag hole of said furnace;

anchoring means for anchoring said support frame to a fixed location, said anchoring means including two slidable vertical posts mounted to said frame for longitudinal movement in a vertical direction between an upraised, rest position and a lowered position lower than the level of a contact zone between rail and wheel; and means for remote control operation of forward and backward movement of the pushing machine and for separately remotely controlling extension and retraction of said extensible arm, and the operation of the anchoring means.

2. The pushing machine according to claim 1, wherein said extensible arm comprises an outer tubular member and at least one inner tubular member co-axially slidable in a telescopic way and actuated by a piston-cylinder assembly co-axial and fixedly mounted to the outer tubular member, wherein the shield is attached to the at least one inner tubular member.

3. The pushing machine according to claim 2, wherein said outer tubular member is pivotally mounted on the frame through a pivot which is directed transversely to the extensible arm for allowing vertical movement of the arm about said pivot and further comprising a piston-cylinder means for controlling said vertical movement.

4. The pushing machine according to claim 2, further comprising an oleodynamic system with an oil tank and a motor-pump unit for pressurizing oil and actuating said piston-cylinder assembly.

5. A pushing machine according to claim 4, wherein said anchoring means further comprises:

a cylinder operated through said oleodynamic system for moving the vertical posts, wherein said posts fit into corresponding seats formed on a slide surface of the rails.

6. The pushing machine according to claim 1, further comprising:

projections mounted on respective brackets on the front zone of the frame for protecting the plurality of wheels, wherein the projections are symmetrical with respect to the extensible arm.

7. The pushing machine according to claim 2, wherein said tubular members (5, 5*a*) have a square cross-section and the outer tubular member is stiffened with ribs (12).

8. The pushing machine according to claim 1, wherein said motor is electrically connected to an electric cable wound on a winding reel mounted on said frame.

9. The pushing machine according to claim 3, further comprising an oleodynamic system with an oil tank and a motor-pump unit for pressurizing oil and actuating said piston-cylinder assembly and said piston-cylinder means.

10. The pushing machine according to claim 2, further comprising:

projections mounted on respective brackets on the front zone of the frame for protecting the plurality of wheels, wherein the projections are symmetrical with respect to the extensible arm.

11. The pushing machine according to claim 3, further comprising:

projections mounted on respective brackets on the front zone of the frame for protecting the plurality of wheels, wherein the projections are symmetrical with respect to the extensible arm.

12. The pushing machine according to claim 4, further comprising:

projections mounted on respective brackets on the front zone of the frame for protecting the plurality of wheels, wherein the projections are symmetrical with respect to the extensible arm.

13. The pushing machine according to claim 5, further comprising:

projections mounted on respective brackets on the front zone of the frame for protecting the plurality of wheels, wherein the projections are symmetrical with respect to the extensible arm.

14. The pushing machine according to claim 4, wherein said motor and motor-pump unit (4) are electrically connected to separate electric cables which are wound together on a winding reel mounted on said frame.

* * * * *